US005350285A

United States Patent [19]

Liskow et al.

[11] Patent Number: 5,350,285

[45] Date of Patent: Sep. 27, 1994

[54] AGGREGATE FOR FEEDING FUEL FROM SUPPLY TANK TO INTERNAL COMBUSTION ENGINE OF MOTOR VEHICLE

[75] Inventors: Uwe Liskow, Kornwestheim; Jochen Thoennissen, Stuttgart; Uwe Loistl, Unterriexingen; Oliver Wahl, Schwieberdingen, all of Fed. Rep. of Germany

[73] Assignee: Robert Bosch GmbH, Stuttgart, Fed. Rep. of Germany

[21] Appl. No.: 97,069

[22] Filed: Jul. 23, 1993

[30] Foreign Application Priority Data

Dec. 3, 1992 [DE] Fed. Rep. of Germany ..... 4240592

[51] Int. Cl.[5] ..... F04C 2/10; F04C 15/00; F02M 37/04; F02M 37/20

[52] U.S. Cl. ..... 418/15; 418/171; 415/55.1

[58] Field of Search ..... 418/15, 166, 171; 415/55.1, 169.1

[56] References Cited

U.S. PATENT DOCUMENTS 2,513,984 7/1950 Witchger ..... 418/171
2,956,512 10/1960 Brundage ..... 418/171
3,034,447 5/1962 Brundage ..... 418/171
3,242,867 3/1966 Mosbacher ..... 418/15
4,697,995 10/1987 Tuckey ..... 418/15

FOREIGN PATENT DOCUMENTS 559230 7/1957 Belgium ..... 418/171
4020520 2/1992 Fed. Rep. of Germany .

*Primary Examiner*—John J. Vrablik
*Attorney, Agent, or Firm*—Michael J. Striker

[57] ABSTRACT

An aggregate for feeding fuel from a supply tank to the internal combustion engine of a motor vehicle, has a pump chamber with a suction opening for receiving fuel and a pressure opening for supplying a fuel and a feeding element rotating in the pump chamber and feeding fuel from the suction opening to the pressure opening. At least one of the chamber end walls in a region of a sealing surface formed between an end surface of the feeding element and one of the chamber walls has an opening which leads to an unloading space, and the opening as considered in a rotary direction of the feeding element is located near one edge which limits the suction opening, and has a radial extension which is at least equal to a radial extension of the suction opening.

6 Claims, 3 Drawing Sheets

FIG. 1
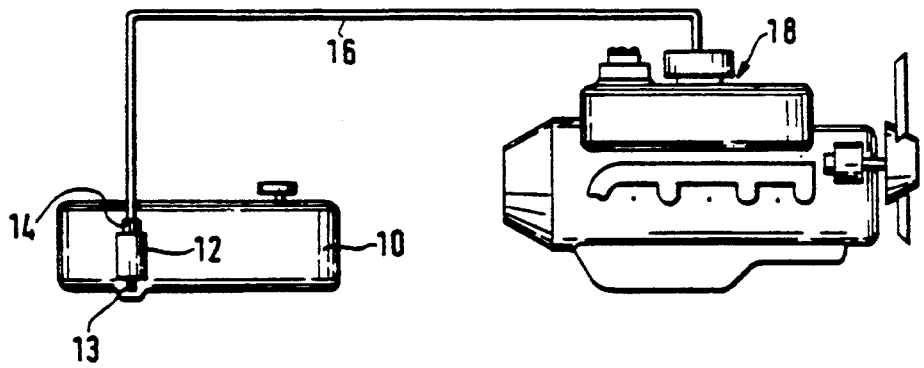
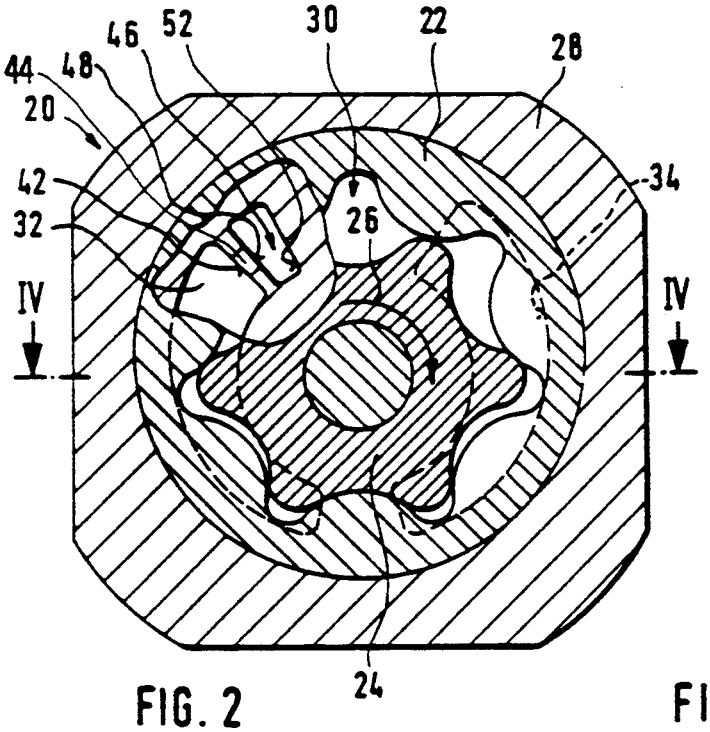
FIG. 2
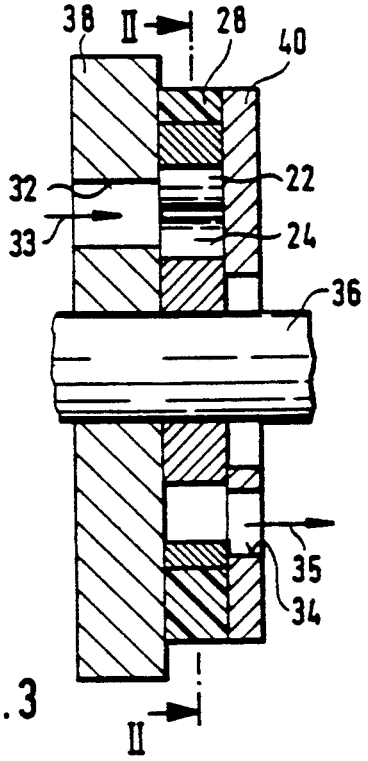
FIG. 3

AGGREGATE FOR FEEDING FUEL FROM SUPPLY TANK TO INTERNAL COMBUSTION ENGINE OF MOTOR VEHICLE

BACKGROUND OF THE INVENTION

The present invention relates to an aggregate for feeding fuel from a supply tank to an internal combustion engine of a motor vehicle.

More particularly, it relates to an aggregate of the above mentioned type which has a feed pump with a rotatable driven feeding element arranged in a pump chamber and feeding fuel from a suction opening of the pump chamber to a pressure opening of the pump chamber, wherein in at least one of two chamber end walls in the region of a sealing surface an opening which leads to an unloading chamber is provided.

Feeding aggregates of the above mentioned general type are known in the art. One of such feeding aggregates is disclosed for example in the German document DE-A 40 20 520. This feeding aggregate has a feed pump which is formed as a flow pump and has a rotatable driven feeding element formed as a vane wheel arranged in a pump chamber. By the vane wheel, fuel during the operation of the feed pump is transported from a suction opening which opens into the pump chamber to a pressure opening which leads from the pump chamber. In a chamber end wall which limits the pump chamber an opening is formed in the region of a sealing surface near the pressure opening so as to communicate the pump chamber with a region of the system in which the low pressure acts. The opening is formed by an unloading passage and an opening which leads from the unloading passage. Gas bubbles which flow back to the suction opening from the pressure opening due to gaps provided between the vane wheel and the chamber end wall are withdrawn through this opening. Otherwise, their suction by the vane wheel disturbs the operation of the feeding aggregate. Due to the arrangement of the unloading passage near the pressure opening, only those gas bubbles are discharged in it which are produced in the region of the pressure opening. Gas bubbles which are produced between the unloading passage and the suction opening can flow back to the suction opening and disturb the operation of the feeding aggregate.

SUMMARY OF THE INVENTION

Accordingly, it is an object of the present invention to provide an aggregate for feeding fuel from a supply tank to an internal combustion engine of a motor vehicle, which avoids the disadvantages of the prior art.

In keeping with these objects and with others which will become apparent hereinafter, one feature of the present invention resides, briefly stated, in an aggregate having a feed pump with a rotatable feeding element arranged in a pump chamber and supplying fuel from a suction opening which opens into the pump chamber to a pressure opening leading from the pump chamber, and also having an opening formed in at least one chamber wall in the region of a sealing surface located between an end surface of the feeding element and the chamber wall, wherein in accordance with the invention the opening is arranged near the edge which limits the suction opening as considered in the rotary direction of the feeding element, and the opening has at least the same radial extension as the suction opening.

When the feeding aggregate is designed in accordance with the present invention, it has the advantage that the gas bubbles which flow back to the suction opening can exit through the opening arranged near the suction opening as considered in the circumferential direction of the feeding element, before reaching the suction opening. Therefore, they cannot be aspirated through the suction opening.

In accordance with another feature of the present invention, the edge surface of the opening which faces in the circumferential direction of the feeding element is inclined so that with its increasing distance from the feeding element in direction of the rotary axis of the feeding element, it approaches the edge of the suction opening.

When the feeding device is designed in accordance with this feature, the formation of the wall part provides for a reliable discharge of the gas bubbles axially away from the feeding element.

In accordance with still a further feature of the present invention, the edge surface of the opening which faces opposite to the rotary direction of the feeding element is inclined oppositely to the oppositely located edge surface. In this construction of the edge surfaces of the opening a further improvement of the discharge of the gas bubbles is provided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view schematically showing a feeding arrangement in accordance with the present invention, which includes a fuel supply tank, fuel feeding aggregate, and an internal combustion engine of a motor vehicle.

FIG. 2 is a view showing a cross-section through the feed pump of the feeding aggregate taken along the line II—II in FIG. 3;

FIG. 3 is a view showing a longitudinal section through the feed pump of the inventive aggregate.

DESCRIPTION OF THE PREFERRED EMBODIMENTS

Figure 2A:
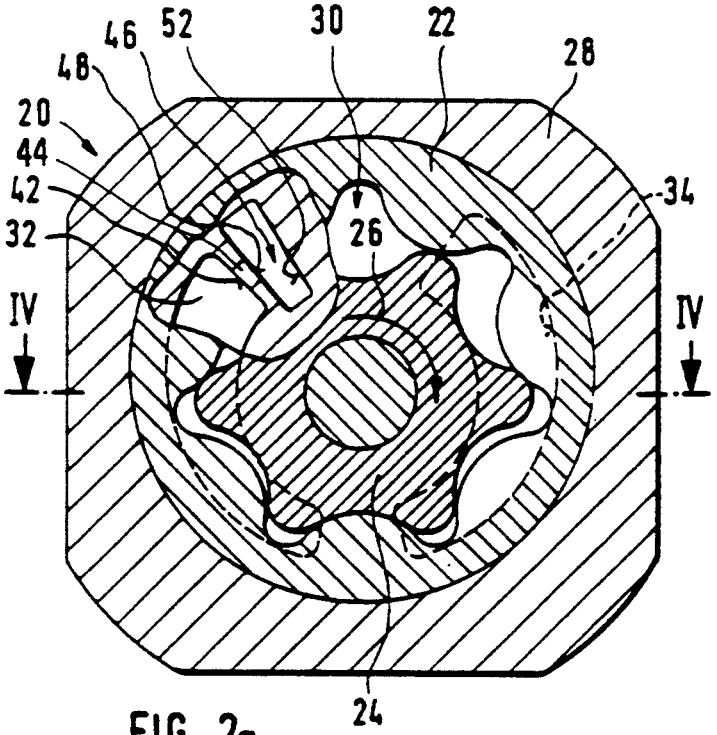
FIG. 2*a* shows a modification of the inventive feed pump.

FIG. 1 shows a fuel supply tank 10 in which a fuel feeding aggregate 12 is arranged. A pressure conduit 16 is connected with a pressure pipe 14 of the fuel feeding aggregate 12 and leads to an internal combustion engine 18. During the operation of the internal combustion engine 18, the fuel feeding aggregate 12 aspirates fuel through a suction pipe 13 from the supply tank 10 and supplies the fuel to the internal combustion engine.

Figure 4A:
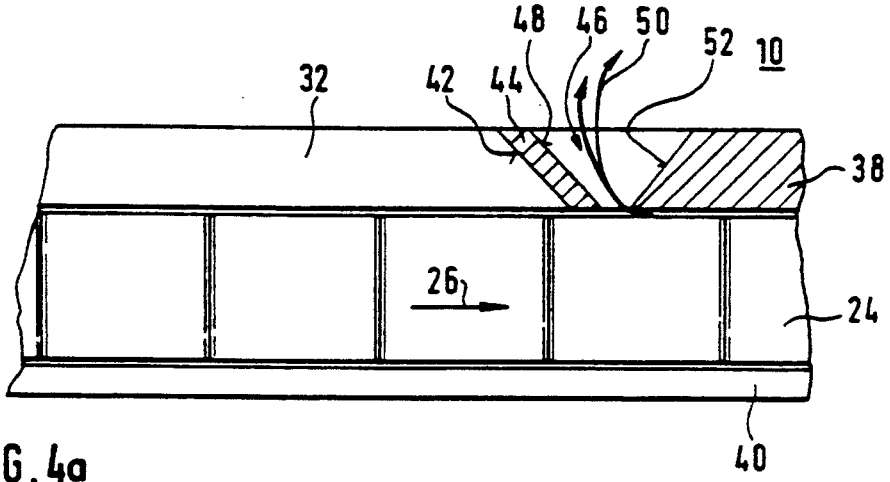
FIGS. 4*a* and 4*b* show further modifications of the inventive feed pump.
Figure 4B:
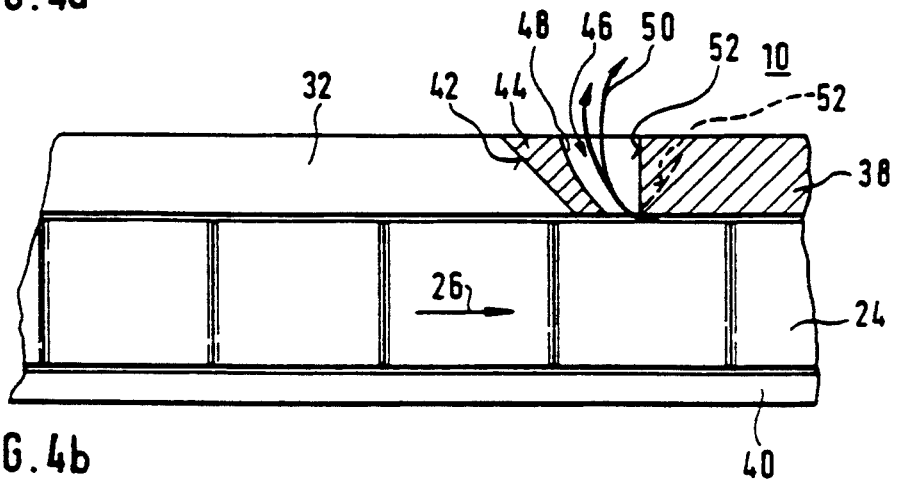
Figure 4:
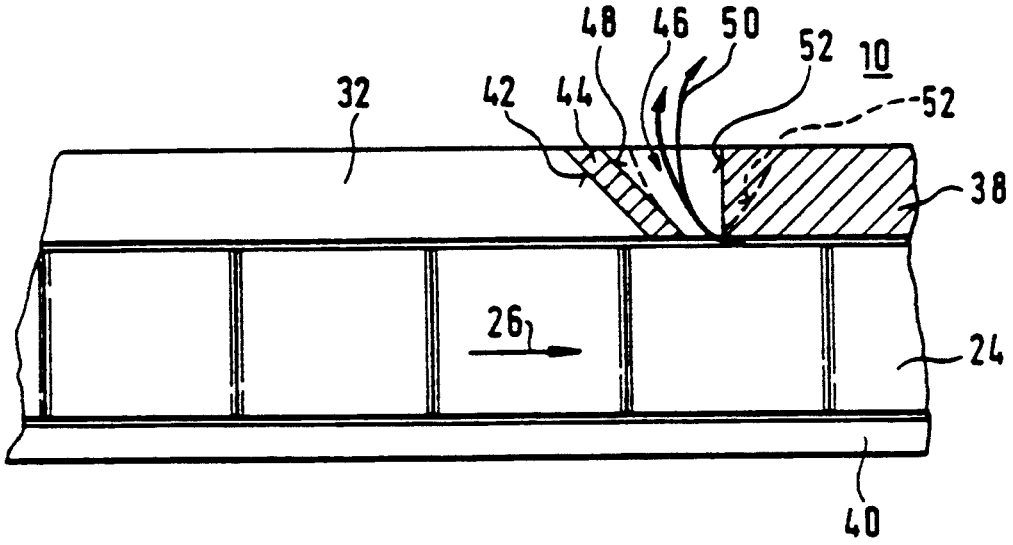
FIG. 4 is a view showing the feed pump in a development along the line IV—IV in FIG. 2.

A feed pump 20 shown in FIGS. 2–4 is a part of the feeding aggregate 12. In the illustrated embodiment it is a displacement pump formed as an inner toothed gear pump. The subsequent description of the invention is however not limited to an inner toothed gear pump, but of course can be applied to a roller cell pump and flow pump as well. The inner toothed gear pump 20 of the shown embodiment has a toothed ring 22 provided with inner teeth and forming a feeding element, and a toothed pinion 24 having outer teeth. The toothed pinion 24 has less teeth than the toothed ring 22 and is arranged eccentrically relative to the latter, so that the toothing of the toothed pinion 24 engages with the toothing of the toothed ring 22. The toothed ring 22 is rotatably supported over its outer periphery in a housing part 28. The toothed pinion 24 is driven by a not shown drive in a rotary movement in the direction of the arrow 26 as shown in FIG. 2. The toothed ring 22 performs a rotary movement corresponding to the rotary movement of the toothed pinion 24. During the operation of the feed pump 20, increased and decreased pump chambers 30 are formed and they pump the medium to be supplied. The toothed ring 22 and the toothed pinion 24 are arranged in a pump chamber which is limited in direction of the rotary axis by two cover plates 38 and 40. In the region of the increasing pump chamber 30, a sickle-shaped inlet or suction opening 32 is formed. The medium to be supplied flows into the pump chamber 30 through the suction opening 32. In the region of the decreasing pump chamber 30 a sickle-shaped outlet or pressure opening 34 is formed as shown in FIG. 2 in a broken line.

FIG. 3 shows a longitudinal section through the feed pump in accordance with FIG. 2. The toothed pinion 24 is rotatably supported on a guiding pin 36 which at one side is fixedly held in the cover plate or suction plate 38. The suction opening 32 is formed in the cover plate 38. A further cover plate or pressure plate is arranged on the side of toothed ring 22 which faces away of the cover plate 38, so that the pump chambers 30 are closed in the direction of the rotary axes of the toothed ring 22 and the toothed pinion 24. The end surfaces of the toothed ring 22 and the associated end surfaces of the cover plate 38 and the pressure plate 40 act as sealing surfaces. The pressure opening 34 is formed in the pressure plate 40. The medium to be supplied flows through the suction opening 32 in the direction of the arrow 33 in the feed pump 20 and leaves it in the direction of the arrow 35 through the pressure opening 34. In the circumferential direction 26 from the edge 42 of the suction opening 32, an opening 46 is formed in the cover plate 38 with a small distance. The suction opening 32 and the opening 46 are separated by a wall part 44 of the cover plate 38. The opening 46 opens into an unloading chamber in which a negative pressure acts and which can act for example as the supply tank 10. The wall part 44 is arranged substantially radially. The radial extension of the opening 46 is substantially equal to the radial extension of the suction opening 32, however, the opening 46 extends in the circumferential direction 26 only over a smaller region of the cover plate 38 with respect to the suction opening 32. The radial extension of the opening 46 can be greater than the radial extension of the suction opening 32 as shown in FIG. 2*a*. The cover plate 38 can for example be composed of synthetic plastic material and contain the opening 46 formed in it.

A development of a section through the feed pump 20 along the line IV—IV is shown in FIG. 4. The edge surface 48 of the opening 46 which faces in the rotary direction 26 is inclined so that with increasing axial distance or in other words in direction of the rotary axes of the toothed ring 22 and the toothed pinion 24, it approaches the edge 42 of the suction opening 32 and expands the opening 46. The surface 48 can be formed flat or curved as shown in FIG. 4*b* .

During the operation of the inventive feeding aggregate, the toothed pinion 24 is driven in the rotary direction 26 and the feed pump 20 aspirates fuel to the suction opening 32 from the supply tank 10 and pumps the fuel through the pressure opening 34. Insignificant gaps are available between the end surface of the toothed ring 22 or the toothed pinion 24 and the end surface of the cover plate 38. Gas bubbles and leakage fuel available in the pump chamber 30 flow back through the gaps in direction of the arrow 50 in FIG. 4 to the suction opening 32. These gas bubbles flow however, before reaching the suction opening 32, through the opening 46 in direction of the rotary axis of the toothed ring 22 or the toothed pinion 24, away from the toothed ring 22 or the toothed pinion 24. Due to the inclined arrangement of the edge surface 48 of the wall portion 44, the gas bubbles deviate away with the low flow resistance from the toothed ring 22 or the toothed pinion 24. The magnitude of the inclination of the edge surface 48 depends on the flow conditions acting in the corresponding feed pump. Depending on the requirements for a good discharge of the gas bubbles through the opening 46, the edge surface 48 can be flat or curved.

Moreover, the edge surface 52 of the opening 46 which is opposite to the edge surface 48 and faces opposite to the rotary direction 26, can be also inclined as shown in FIG. 4*a*. Its inclination can be counter to the inclination of the surface 48 of the wall part 44, so that the opening 46 expands with increasing axial distance from the toothed ring 22 or the toothed pinion 24. The experiments have shown that a tangential flow acts on the outer side of the cover plate 38, which rinses back the gas bubble exiting the opening 46 from the suction opening 32 and therefore cannot be aspirated again by the feed pump 20. The flow of the gas bubbles has a strong deviation which is facilitated by the inclined construction of the edge surface 52 of the opening 46, since the flow can be deviated inside the opening 46.

It will be understood that each of the elements described above, or two or more together, may also find a useful application in other types of constructions differing from the types described above.

While the invention has been illustrated and described as embodied in an aggregate for feeding fuel from a supply tank to an internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An aggregate for feeding fuel from a supply tank to the internal combustion engine of a motor vehicle, comprising means forming a pump chamber with a suction opening for receiving fuel and a pressure opening for supplying a fuel, said means including chamber end walls; a feeding element rotating in said pump chamber and feeding fuel from said suction opening to said pressure opening, at least one of said chamber end walls in a region of a sealing surface formed between an end surface of said feeding element and one of said chamber walls being provided with an opening which leads to an unloading space, said opening as considered in a rotary direction of said feeding element being located near one edge which limits said suction opening, said opening having a radial extension which is at least equal to a radial extension of said suction opening, said opening having an edge surface facing in the rotary direction of said feeding element and inclined so that with an increasing distance from said feeding element in direction of a rotary axis of said feeding element it approaches said edge of said suction opening.

2. A feeding aggregate as defined in claim 1, wherein said edge surface of said opening, which faces in said rotary direction of said feeding element is curved.

3. A feeding aggregate as defined in claim 1, wherein said edge surface of said opening, which faces in said rotary direction of said feeding element is flat.

4. A feeding aggregate as defined in claim 1, wherein said opening has a further edge surface facing opposite to said rotary direction of said feeding element and being inclined to said first mentioned edge surface, said edge surfaces being located opposite to one another.

5. A feeding aggregate as defined in claim 1; and further comprising a cover part which limits said pump chamber, said suction opening being formed in said cover part of said pump chamber, said opening being also formed in said cover part.

6. A feeding aggregate as defined in claim 1, wherein said opening has a radial extension which is greater than a radial extension of said suction opening.

* * * * *